US006763885B2

(12) United States Patent
Cavender

(10) Patent No.: US 6,763,885 B2
(45) Date of Patent: Jul. 20, 2004

(54) METHOD OF GRAVEL PACKING FOR A GAS STORAGE AND PRODUCTION SYSTEM

(75) Inventor: Travis Wayne Cavender, Angleton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 10/289,189

(22) Filed: Nov. 5, 2002

(65) Prior Publication Data

US 2003/0063952 A1 Apr. 3, 2003

Related U.S. Application Data

(62) Division of application No. 09/923,211, filed on Aug. 6, 2001.

(51) Int. Cl.[7] ..... E21B 43/04; E21B 33/13

(52) U.S. Cl. ..... 166/278; 166/285; 166/228; 166/51

(58) Field of Search ..... 166/278, 285, 166/228, 51

(56) References Cited

U.S. PATENT DOCUMENTS 3,277,962 A * 10/1966 Flickinger et al. ..... 166/278
3,489,216 A * 1/1970 Armstrong et al. ..... 166/126
3,891,034 A * 6/1975 Owen et al. ..... 166/285
4,491,178 A * 1/1985 Terrell et al. ..... 166/192
4,808,029 A 2/1989 Grupping ..... 405/59
5,033,549 A * 7/1991 Champeaux et al. ..... 166/278
5,419,655 A 5/1995 Phillips et al. ..... 405/52
6,176,307 B1 * 1/2001 Danos et al. ..... 166/51
6,311,776 B1 11/2001 Pringle et al. ..... 166/313
6,397,946 B1 * 6/2002 Vail, III ..... 166/250.01
6,457,525 B1 10/2002 Scott ..... 166/300

* cited by examiner

*Primary Examiner*—David Bagnell
*Assistant Examiner*—Shane Bomar
(74) *Attorney, Agent, or Firm*—J. Richard Konneker; Marlin R. Smith

(57) ABSTRACT

A gas storage and production system decreases production of formation sand and permits high gas flow rates in storing and producing operations. In a described embodiment, different flowpaths are used for injecting and withdrawing gas from a subterranean formation. In another embodiment, a gravel pack is confined to a set volume, so that it is not expanded when gas flows at a relatively high rate therethrough.

8 Claims, 7 Drawing Sheets

METHOD OF GRAVEL PACKING FOR A GAS STORAGE AND PRODUCTION SYSTEM

This is a division, of application Ser. No. 09/923,211, filed Aug. 6, 2001, such prior application being incorporated by reference herein in its entirety.

BACKGROUND

The present invention relates generally to gas storage in subterranean formations and, in an embodiment described herein, more particularly provides a gas storage and production system.

Natural gas stored underground is typically stored in leached out salt dome caverns or in depleted hydrocarbon-bearing formations. Where depleted formations are utilized, the formations are generally unconsolidated or poorly consolidated sandstones, which makes it possible to flow gas into and out of pores of the formations at high flow rates.

To prevent production of formation sand when gas is withdrawn from the formations, gravel packing is typically used. In a gravel packing operation, gravel (e.g., sand, ceramic or bauxite proppant, etc.) is placed in an annulus between a sand screen and a wellbore intersecting a formation. The gravel provides structure against which the formation sand bridges off, thereby preventing migration of the formation sand through the gravel, while permitting gas to flow therethrough.

In a common method of injecting gas into, and withdrawing gas from, a storage formation, a single tubing string is used for both the injecting and withdrawing operations. That is, the same tubing string is used to store the gas in the formation as is used to produce the stored gas from the formation. Thus, gas is alternately flowed from the surface through the tubing string into the formation, and from the formation through the tubing string to the surface.

Unfortunately, several problems are associated with this method. One problem is that only a single wellbore is available for both storage and production operations. Another problem is that when operations shift between storage and production, a flow reversal is experienced at the gravel pack in the wellbore. This flow reversal disturbs the gravel and the formation sand bridges therein, thereby escalating the migration of formation sand through the gravel.

Yet another problem with gravel packs in gas storage wells has to do with the high flow rates generally used in these wells. Typical gravel packs have an open upper end, and so the gravel is not fully contained. High gas flow rates through these gravel packs cause the gravel to move about, "fluffing" the gravel so that it has more open space between its grains. This makes it easier for formation sand to migrate through the spaces between the grains of gravel.

When formation sand migrates through a gravel pack, it enters the production flowpath and erodes equipment, plugs passages and must be separated from the produced gas. Each of these undermines the profitability of the operation. Therefore, it may be seen that it would be highly advantageous to provide a gas storage and production system which addresses some or all of the above problems.

SUMMARY

In carrying out the principles of the present invention, in accordance with an embodiment thereof, a gas storage and production system is provided which enhances the profitability of subterranean gas storage by preventing or at least substantially decreasing migration of formation sand through a gravel pack.

In one aspect of the invention, a gas storage and production system is provided. The system includes a gas storage formation, a production and storage wellbores and a junction between the storage and production wellbores. The system is of the type wherein gas is stored within pores of formation rock, such as in a depleted hydrocarbon-bearing formation.

The production wellbore extends into the formation for withdrawing gas from the formation. The storage wellbore also extends into the same formation for injecting gas into the formation. In this manner, it is not necessary for a single wellbore to be used for both injecting and producing the gas.

In another aspect of the invention, a gas storage and production system is provided wherein production and storage wellbores extend from a wellbore junction at a main wellbore. The main wellbore extends from the earth's surface to the wellbore junction. The storage and production wellbores each extend from the wellbore junction into a gas storage formation. Gas is injected from the main wellbore into the formation via the storage wellbore, and gas is withdrawn from the formation into the main wellbore via the production wellbore.

In yet another aspect of the invention, various means may be utilized for delivering gas to the storage wellbore for injection into the formation, and for delivering gas from the production wellbore to the earth's surface. For example, a single tubular string may be used to deliver the gas to the storage wellbore, and the gas may be received from the production wellbore into an annulus between the tubular string and the main wellbore for flowing to the earth's surface. As another example, a single tubular string may be used for alternately delivering gas to the storage wellbore and receiving gas from the production wellbore. As yet another example, separate tubular strings may be used for delivering gas to the storage wellbore and receiving gas from the production wellbore.

Also provided is a method of gravel packing a wellbore, which is particularly useful in high flow rate gas production of the type typically experienced in gas storage and production systems. The method includes the steps of positioning a sand control device in the wellbore, placing gravel in an annulus formed between the sand control device and the wellbore, and flowing a retainer material into the annulus. The retainer material prevents displacement of the gravel in the annulus.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
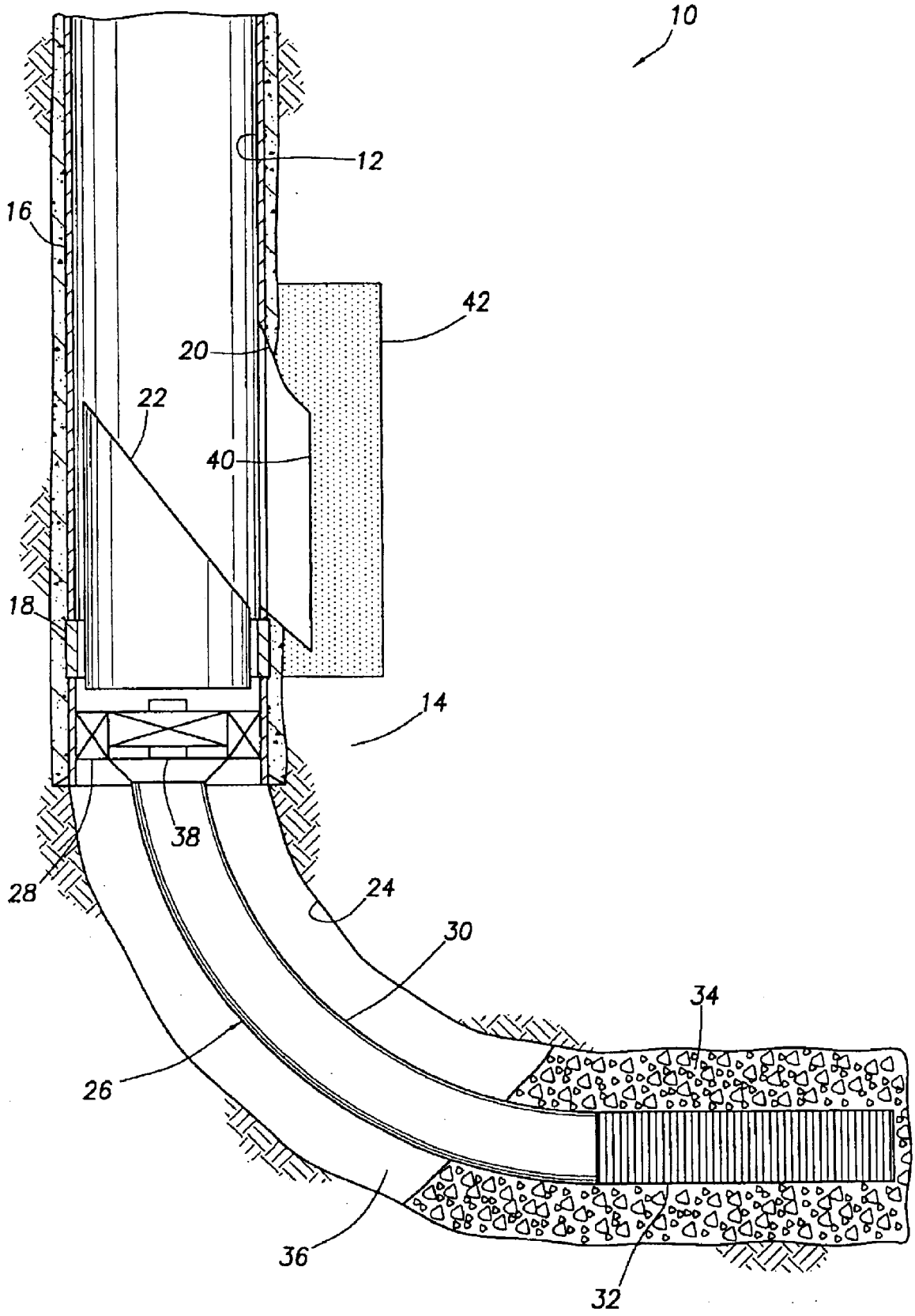
FIG. 1 is a schematic view of a gas storage and production system embodying principles of the present invention, wherein main and storage wellbores have been drilled, and the storage wellbore has been gravel packed.

Representatively illustrated in FIG. 1 is a gas storage and production system 10 which embodies principles of the present invention. In the following description of the system 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

As depicted in FIG. 1, initial steps of a method used to practice the system have been performed. A main wellbore 12 has been drilled, cased and cemented, so that it extends from the earth's surface into a formation 14 in which it is desired to store gas. It is not necessary, however, for the main wellbore 12 to extend into the formation 14.

A casing string 16 cemented in the main wellbore 12 includes an orienting latch coupling 18 of the type well known to those skilled in the art. The latch coupling 18 is positioned below a desired exit window 20 through the casing 16, so that, when a whipstock 22 is latched into the coupling 18, a window mill (not shown) will be directed to mill through the casing at the desired position and in the desired direction. Note that the window 20 may be preformed, or at least provided for, in the casing string 16 when installed, for example, by including an item of equipment known to those skilled in the art as a window bushing or a window joint in the casing string.

After the casing string 16 is cemented in the main wellbore 12, a storage wellbore 24 is drilled as an extension of the main wellbore. Alternatively, the storage wellbore 24 could be drilled as a lateral or branch wellbore from the main wellbore 12. As shown in FIG. 1, the storage wellbore 24 is deviated, so that it extends substantially horizontally in the formation 14. This maximizes the surface area of the formation 14 exposed to the storage wellbore 24 to increase the flow rate at which gas may be flowed from the storage wellbore into the formation. However, it is to be clearly understood that it is not necessary for the storage wellbore 24 to be horizontal or deviated in the formation 14.

After the storage wellbore 24 is drilled, a sand control assembly 26 is installed in the storage wellbore. The sand control assembly 26 may be conventional and may include a gravel pack packer 28 (which is preferably set in the casing 16 above the storage wellbore), a tubular string 30 and a sand control device 32. Of course, if the formation 14 is well consolidated, or there is otherwise no need for controlling influx of formation sand into the storage wellbore 24, then the sand control assembly 26 may not be used.

The sand control device 32 is representatively illustrated in FIG. 1 as a tubular screen of the kind well known to those skilled in the art. The screen 32 may be any type of well screen, including a wire-wrapped screen, a sintered metal screen, a wire mesh screen, etc. Other types of sand control devices may also be used in the system 10, such as slotted or perforated liners, etc. Therefore, the terms "sand control device" and "sand control screen" as used herein are to be taken as including any apparatus or device which excludes particulate matter, but permits liquid or gas to flow therethrough.

After the sand control assembly 26 is positioned in the storage wellbore 24, the wellbore is gravel packed. That is, gravel 34 is placed in an annulus 36 formed between the sand control assembly 26 and the wellbore 24. Placement of the gravel 34 is accomplished using techniques well known to those skilled in the art. For example, a workstring (not shown) may be used to flow a gravel slurry from the workstring outward through a crossover tool (not shown) below the packer 28. Of course, other methods of gravel packing the storage wellbore 24 may be used without departing from the principles of the present invention.

After the storage wellbore 24 is gravel packed, a plug 38 is installed in the packer 28. The plug 38 prevents debris from the window milling and cementing operations described below from passing into the sand control assembly 26. Otherwise, this debris could fully or partially plug the screen 32, thereby preventing or decreasing the flow of gas therethrough.

A whipstock 22, or other deflection device, is then installed in the main wellbore 12. The latch coupling 18 secures the whipstock 22 longitudinally in the casing 16 and orients the whipstock so that it faces in the desired direction for milling the window 20 through the casing. A window mill (not shown) or other cutting device is then deflected off of the whipstock 22, so that it cuts the window 20 through the casing 16.

At this point, or after passing additional cutting tools, such as one or more drills, through the window 20, an initial recess 40 is cut into the formation 14 beyond the cemented casing 16. Preferably, a permeability reducing material 42 is then forced outwardly into the formation 14 surrounding the recess 40. The material 42 may be, for example, a plastic resin, a polymer, a cementitious material, a material known as PermaSeal™, etc. The main purpose of using the material 42 is to prevent gas in the formation 14 surrounding the window 20 from passing through the window into the casing 16. However, use of the material 42 is not necessary in keeping with the principles of the present invention.

Figure 2:
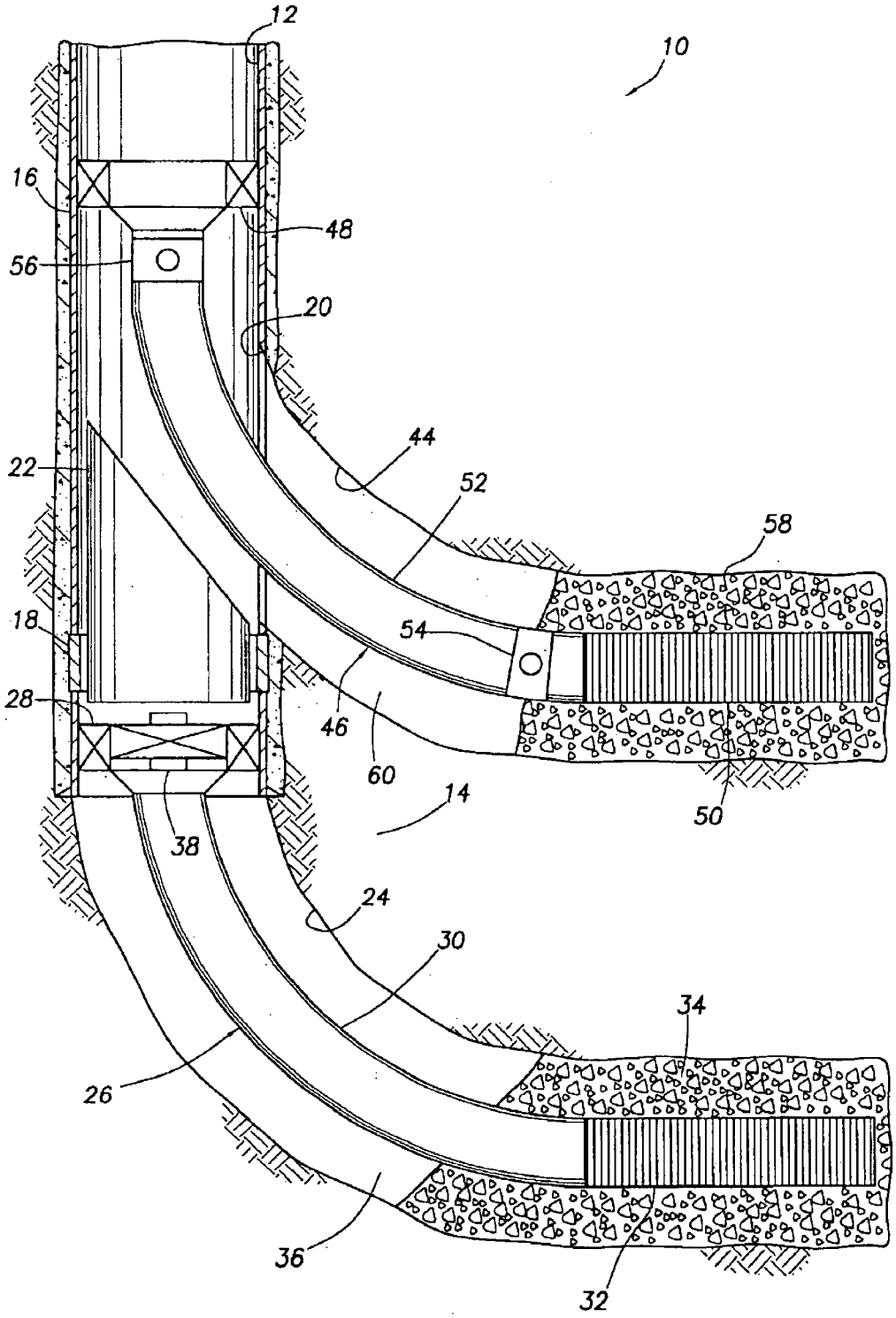
FIG. 2 is a schematic view of the system of FIG. 1, wherein a production wellbore has been drilled and gravel packed.

Referring additionally now to FIG. 2, the system 10 is depicted with further steps having been performed. The recess 40 has been extended outward into the formation 14, for example, by deflecting one or more drill bits off of the whipstock 22 and through the window 20, thereby forming a production wellbore 44. The production wellbore 44 is preferably deviated or substantially horizontal in the formation 14 to expose a greater surface area of the formation to the wellbore, but this is not necessary in keeping with the principles of the invention.

Another sand control assembly 46 is installed in the production wellbore 44. A packer 48 of the sand control assembly 46 is set in the casing 16 above the window 20, a sand control screen 50 is installed in the production wellbore 44, and a tubular string 52 extends between the packer and the screen. The sand control assembly 46 is similar to the sand control assembly 26 described above, but may differ in some respects.

In particular, the sand control assembly 46 may include ported collars 54, 56 of the type used in cementing operations, interconnected in the tubular string 52 between the packer 48 and the screen 50. Preferably, the ported collar 54 is positioned between the window 20 and the screen 50, and the ported collar 56 is positioned between the packer 48 and the window. The use of the ported collars 54, 56 in the system 10 is described in more detail below.

After installing the sand control assembly 46, the production wellbore 44 is gravel packed using techniques well known to those skilled in the art. Gravel 58 is placed in an annulus 60 between the sand control assembly 46 and the production wellbore 44 about the screen 50. Preferably, the gravel 58 extends somewhat beyond the ports in the lower ported collar 54.

One of the inventive aspects of the system 10 is a manner in which the gravel 58 is retained in the wellbore 44 about the screen 50. Due to high flow rates of gas from a storage formation into a screen through a conventional gravel pack, the gravel is typically made to move about, disturbing any sand bridging that had previously developed, and permitting increased migration of sand through the gravel pack.

One reason the gravel in a conventional gravel pack is able to move about due to high gas flow rates therethrough is that the annulus above the gravel pack is typically open. That is, the upper level of a conventional gravel pack is typically spaced apart from the packer, leaving the annulus therebetween available for the gravel to displace into.

An example of this is shown in the accompanying figures wherein the storage wellbore 24 is gravel packed. The gravel 34 spaced apart from the packer 28, leaving the annulus 36 open therebetween. This does not present a problem of sand migration in the system 10, however, since gas preferably flows outward from the sand control assembly 26 into the formation 14, and not in the other direction, which is another significant advantage of the system.

For the production wellbore 44, wherein gas flows from the formation 14 into the sand control assembly 46, the problem of gravel movement is reduced or eliminated by retaining the gravel 58 in the annulus 60 about the screen 50, so that it cannot displace upward in the annulus 60.

Figure 3:
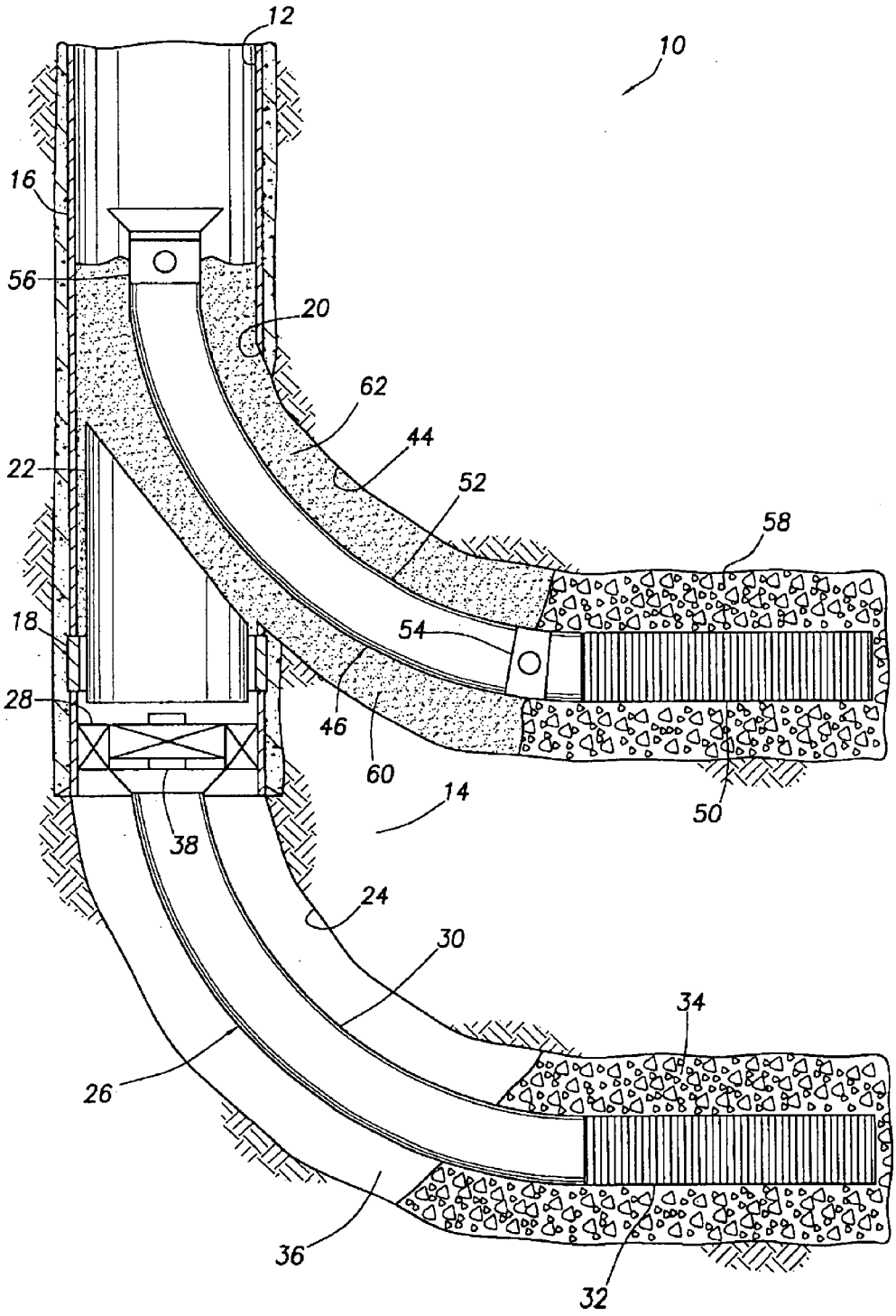
FIG. 3 is a schematic view of the system of FIG. 1, wherein cement has been placed above the storage wellbore gravel pack.

Referring additionally now to FIG. 3, the system 10 is depicted wherein additional steps have been performed. Specifically, a retainer material 62 has been flowed into the annulus 60 above the gravel 58. The retainer material 62 is flowed outward into the annulus 60 through the lower ported collar 54, and is flowed upward through the annulus, until it extends through the window 20. During this process, returns are taken from the annulus 60 through the upper ported collar 56.

Preferably, the retainer material 62 is cement or another cementitious material. In that case, conventional cementing techniques may be used to place the cement 62 in the annulus 60 above the gravel 58. For example, a workstring, such as a coiled tubing string (not shown), may be inserted into the sand control assembly 46 and used to open the ported collars 54, 56 prior to pumping the cement through the workstring into the annulus 60. Withdrawal of the workstring may cause the ported collars 54, 56 to close.

Any of the gravel 58 above the ports in the ported collar 54 will be displaced along with the cement 62 as it is flowed into the annulus 60. This procedure will ensure intimate contact between the cement 62 and the top of the gravel 58 in the annulus 60. Thus, when the cement 62 sets or hardens in the annulus 60, it will prevent the gravel 58 from displacing when gas flows therethrough at a high rate. Note that the gravel 34 in the storage wellbore 24 could similarly be retained in keeping with the principles of the invention.

Of course, materials other than cement may be used for the retainer material 62. For example, a polymer material may be flowed into the annulus 60 above the gravel 58. Such a material may gel instead of harden when set. A gelatinous material may be used. In short, any material which may serve to prevent displacement of the gravel 58 in the annulus 60 can be used for the retainer material 62.

After the retainer material 62 is permitted to set in the annulus 60, the packer 48 is retrieved from the main wellbore 12. Alternatively, the packer 48 could be retrieved before placing the retainer material 62 in the annulus 60, in which case there would be no need to include the upper ported collar 56 in the tubular string 52.

Figure 4:
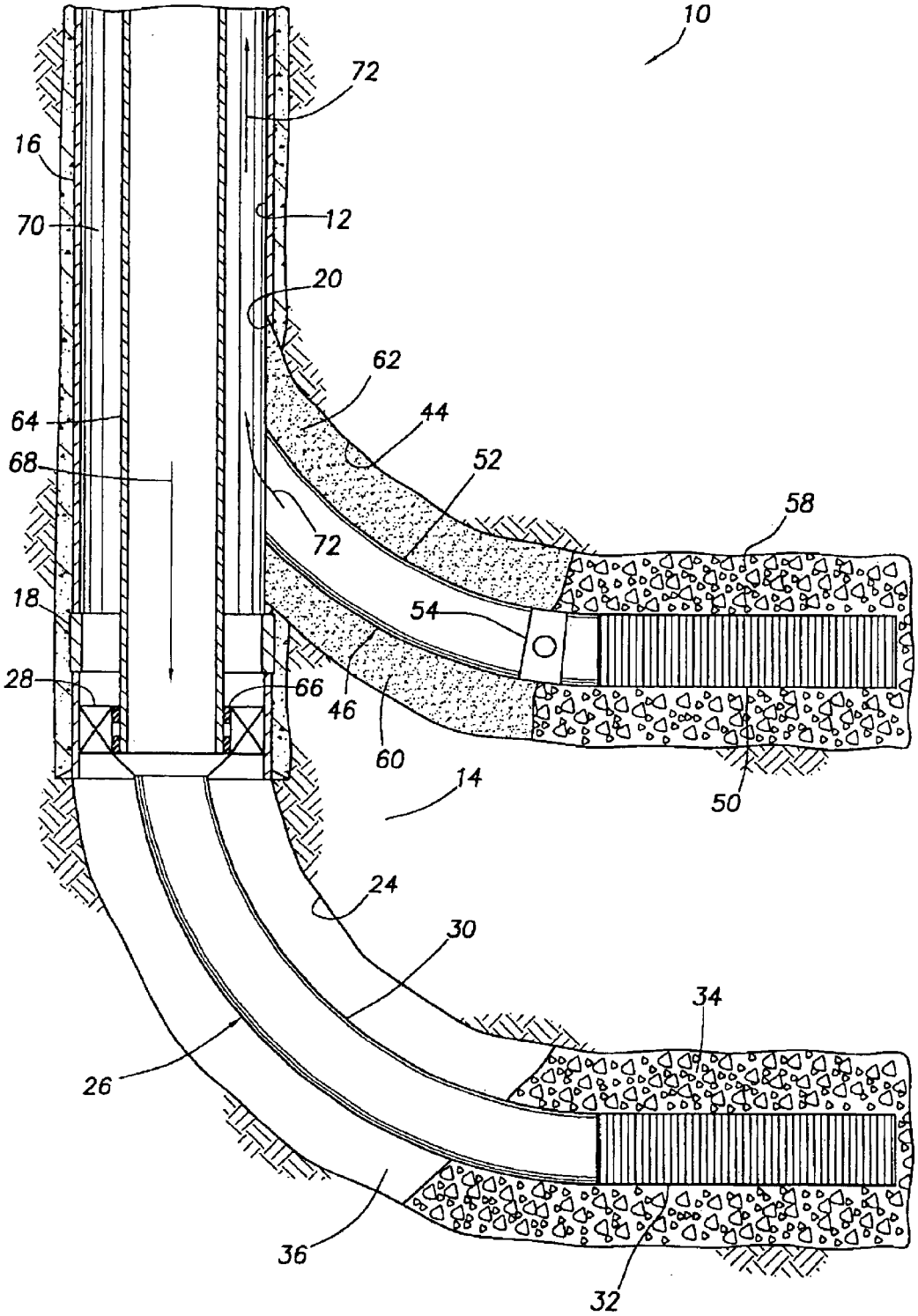
FIG. 4 is a schematic view of the system of FIG. 1, wherein a first method of storing and producing the gas has been implemented.

Referring additionally now to FIG. 4, the system 10 is depicted wherein further steps have been performed. The sand control assembly 46 extending inwardly through the window 20 has been milled away, so that the tubular string 52 terminates at the window. Any retainer material 62 left in the casing string 16 has also been removed. The whipstock 22 has been retrieved, for example, by using a washover tool well known to those skilled in the art. The plug 38 has been retrieved from the packer 28.

A tubing string 64 having a seal assembly 66 proximate a lower end thereof is installed in the main wellbore 12. The seal assembly 66 is stabbed into the packer 28 or an associated seal bore extension. The tubing string 64 now provides a conduit for injecting gas from the earth's surface, into the sand control assembly 26 in the storage wellbore 24, and outward into the formation 14. The direction of gas flow is indicated by the arrow 68.

Another conduit for gas flow is provided by an annulus 70 formed between the tubing string 64 and the wellbore 12. Gas is received into the annulus 70 from the sand control assembly 46, which in turn receives the gas from the formation 14. The gas may be flowed to the earth's surface in the annulus 70, in the direction indicated by arrows 72.

Preferably, the directions of gas flow indicated by arrows 68, 72 are not reversed in normal gas storage and production operations. Thus, the problems of flow reversal are substantially, if not totally, eliminated. In the storage wellbore 24, gas is preferably only flowed into the formation 14. In the production wellbore 44, gas is preferably only flowed out of the formation 14. Of course, these flow directions could be reversed if conditions warrant.

It should also be clearly understood that it is not necessary for the gas to be injected via the tubing string 64 and the gas to be produced via the annulus 70. The gas could instead be injected via the annulus 70 and produced via the tubing string 64. For example, the tubing string 64 could extend into the production wellbore 44, where the seal assembly 66 could be stabbed into a seal bore (not shown) of the tubular string 52.

Figure 5:
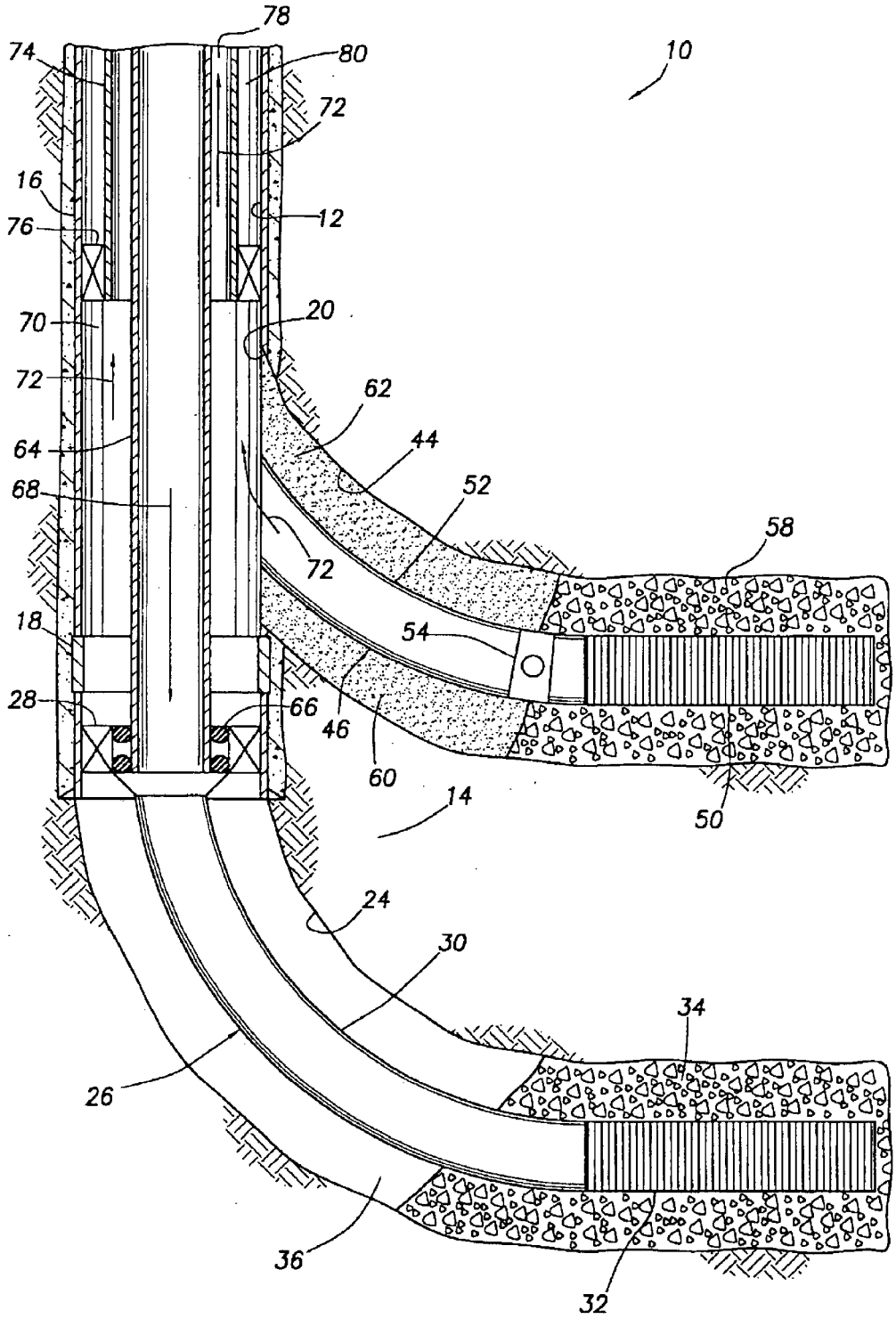
FIG. 5 is a schematic view of the system of FIG. 1, wherein a second method of storing and producing the gas has been implemented.

Referring additionally now to FIG. 5, the system 10 is depicted wherein an alternate method of storing and producing the gas in the formation 14 is used. In this version, the tubing string 64 is installed in the main wellbore 12 and a seal assembly 66 is stabbed into the packer 28, or a seal bore associated therewith, as described above for the version depicted in FIG. 4. However, another tubing string 74 is installed in the main wellbore 12, and a packer 76 on the tubing string is set in the casing 16 above the window 20.

As with the version depicted in FIG. 4, gas is preferably injected into the formation 14 via the tubing string 64. However, the gas is produced via an annulus 78 formed between the tubing strings 64, 74. This method may be more desirable in jurisdictions where an annulus extending to the earth's surface, such as the annulus 80 between the tubing string 74 and the wellbore 12, must be available for well control and monitoring, and cannot be used for production. Use of the tubing string 74 provides the additional annulus 78 for production of the gas, leaving the annulus 80 available for well control and monitoring.

As shown in FIG. 5, the tubing strings 64, 74 are concentric or coaxial, and the flow of gas is as indicated by the arrows 68, 72. However, it is to be clearly understood that the tubing strings 64, 74 could be otherwise positioned, and the gas flow could be otherwise directed, in keeping with the principles of the invention. For example, the tubing strings 64, 74 could be positioned side-by-side in the main wellbore 12, the gas could be produced through the interior bore of the tubing string 64, the gas could be injected through the interior bore of the tubing string 74, etc.

Figure 6:
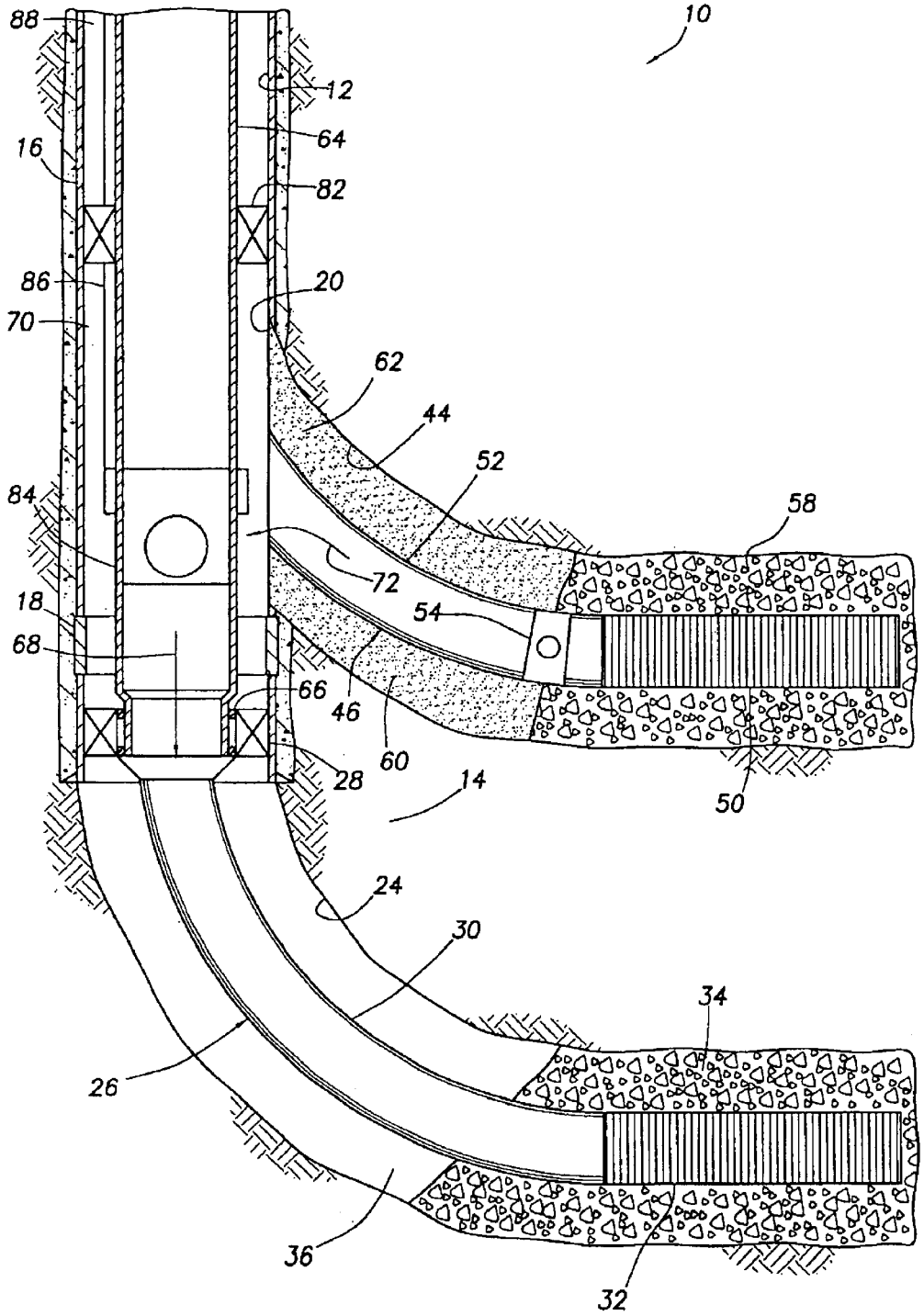
FIG. 6 is a schematic view of the system of FIG. 1, wherein a third method of storing and producing the gas has been implemented.

Referring additionally now to FIG. 6, the system 10 is depicted wherein another alternate method of producing and storing gas in the formation 14 is used. As with the previously described versions, the tubing string 64 is installed in the main wellbore 12 and the seal assembly 66 is stabbed into the packer 28. However, in this version, the tubing string 64 includes a packer 82, which is set in the casing 16 above the window 20, and a valve 84, which is positioned between the packers 28, 82.

The valve 84 is of the type well known to those skilled in the art which alternately permits flow through its sidewall and its internal longitudinal bore. That is, the valve 84 has two positions—in the first position the valve permits flow through its sidewall but prevents flow through its internal bore, and in the second position the valve prevents flow through its sidewall and permits flow through its internal bore. Such valves are used in several oilfield operations, including drill stem testing, where the valves are known as "tester" valves. An example is the Omni™ valve available from Halliburton Energy Services, Inc.

The valve 84 may be of the type which uses pressure in a control line 86 to control its operation, as is commonly used in subsea operations. However, other actuation means may be used, such as acoustic, electromagnetic, etc., telemetry from a remote location, pressure or pressure pulses in the tubing string 64 or annulus 70, etc.

When the valve 84 is in its first position, gas is produced from the production wellbore 44, through the sidewall of the valve, and to the earth's surface via the tubing string 64 above the valve. Flow between the storage wellbore 24 and the tubing string 64 above the valve 84 is prevented by the valve. Thus, when it is desired to produce gas from the formation 14, the valve 84 is operated to its first position.

When the valve 84 is in its second position, gas is injected through the tubing string 64, through the internal bore of the valve, and into the storage wellbore 24. Flow between the production wellbore 44 and the tubing string 64 is prevented by the valve 84. Thus, when it is desired to store gas in the formation 14, the valve is operated to its second position.

An advantage of this method shown in FIG. 6 is that only a single tubing string 64 is needed to both store and produce gas via the multiple wellbores 24, 44, while leaving an annulus 88 extending to the earth's surface above the packer 82 available for well control. No flow reversal occurs in any gravel pack of the system 10. The valve 84 is merely alternated between its first and second positions as needed to store or produce the gas.

Figure 7:
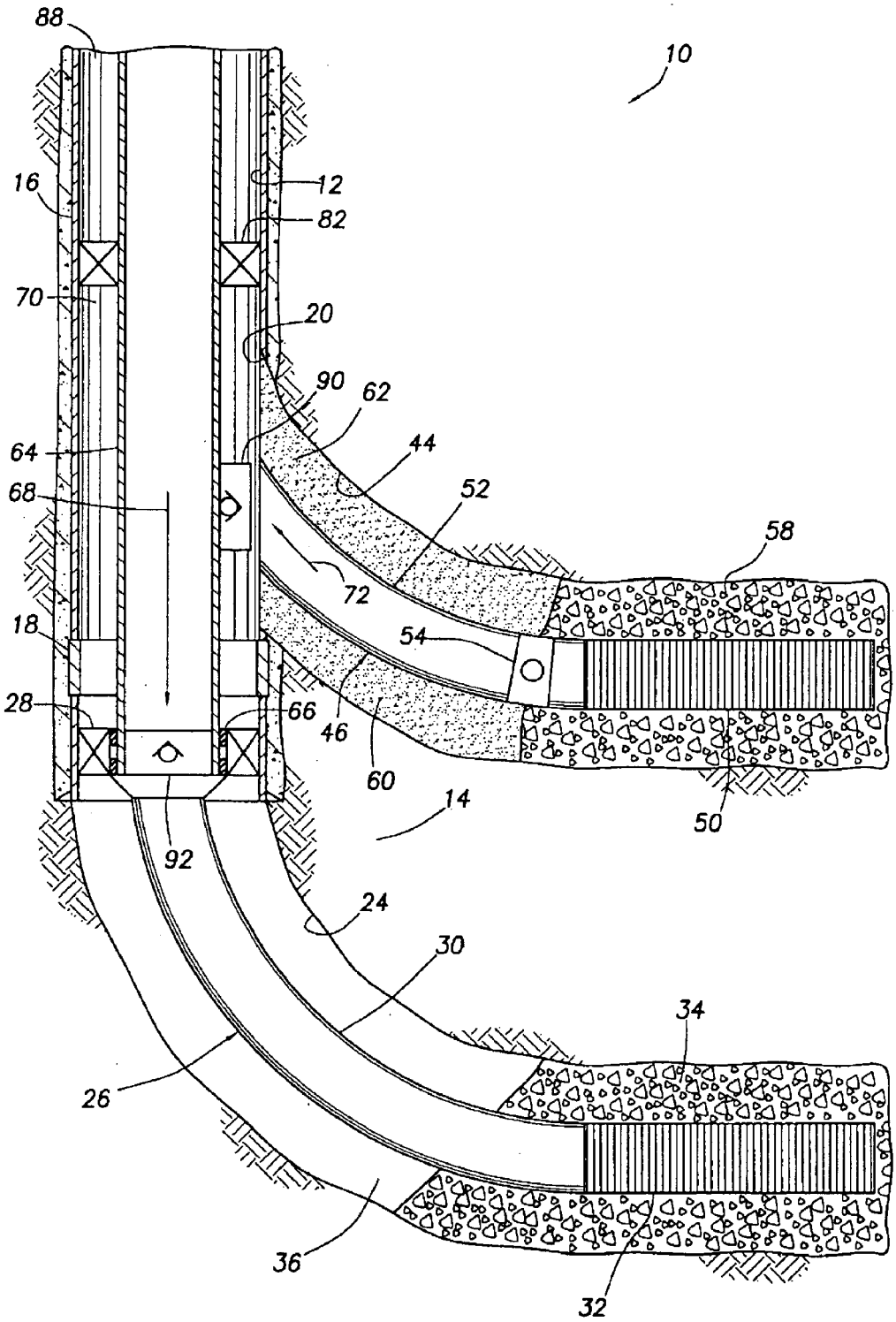
FIG. 7 is a schematic view of the system of FIG. 1, wherein a fourth method of storing and producing the gas has been implemented.

Referring additionally now to FIG. 7, the system 10 is depicted wherein yet another method of storing and producing the gas is used. This method is similar to the method shown in FIG. 6 except that, instead of the valve 84, two check valves 90, 92 are used to control flow between the tubing string 64 and each of the storage and production wellbores 24, 44.

The check valve 90 prevents flow from the interior of the tubing string 64 to the production wellbore 44, but permits flow from the production wellbore to the interior of the tubing string. The check valve 92 prevents flow from the storage wellbore 24 to the interior of the tubing string 64, but permits flow from the interior of the tubing string to the storage wellbore.

When it is desired to produce gas from the formation 14, pressure in the tubing string 64 is decreased below that in the production wellbore 44. This pressure differential opens the check valve 90 and gas flows from the production wellbore 44, through the check valve 90, into the tubing string 64, and to the earth's surface. The pressure in the tubing string 64 is also less than pressure in the storage wellbore 24, which maintains the check valve 92 in its closed position.

When it is desired to inject gas into the formation 14, pressure in the tubing string 64 is increased above that in the storage wellbore 24. This pressure differential opens the check valve 92, and gas flows from the tubing string 64, through the check valve, and into the storage wellbore 24. The pressure in the tubing string 64 is also greater than pressure in the production wellbore 44, which maintains the check valve 90 in its closed position.

Biasing devices, such as springs, may be added to the check valves 90, 92, so that predetermined pressure differentials are needed to open the valves. This may also ensure more positive closing of the valves 90, 92 and/or allow greater latitude in the pressures which may be applied to the tubing string 64 to open or close the valves as desired.

The check valves 90, 92 are shown schematically in FIG. 7 as being separate valves spaced apart in the tubing string 64. However, these valves 90, 92 could be otherwise configured and positioned in keeping with the principles of the present invention. For example, the valves 90, 92 could be combined into a single assembly, the valves could be retrievable by slickline or coiled tubing, etc.

Note that the system 10 as depicted in FIG. 7 also has the advantage of using only a single tubing string 64 to inject and produce gas in the multiple wellbores 24, 44, while leaving the annulus 88 available for well control. This storage and production of gas through the tubing string 64 is accomplished without requiring flow reversal in any gravel pack of the system 10.

In the accompanying FIGS. 1–7 depicting several embodiments of the invention, the production wellbore 44 is shown as intersecting the main wellbore 12 at a wellbore junction, and the storage wellbore 24 is shown as being an extension of the main wellbore. The main wellbore 16 is cased, while the production and storage wellbores 24, 44 are uncased. The production wellbore 44 is above the storage wellbore 24. However, it is to be clearly understood that these examples of embodiments of the invention are merely used for illustration purposes. The main wellbore 12 could be uncased at its junction with the production and/or storage wellbores 24, 44, the storage and/or production wellbores could be cased, the storage wellbore could be above the production wellbore, the storage wellbore could intersect the main wellbore at a wellbore junction, the production wellbore could be an extension of the main wellbore, etc.

The junction between the main wellbore 12 and the production wellbore 44 has been depicted in the drawings and described above as one in which the tubular string 52 in the production wellbore extends into the main wellbore and is cemented at least up to the window 20. However, it is to be understood that other types of wellbore junctions may be utilized, without departing from the principles of the present invention. For example, any of the wellbore junctions known to those skilled in the art as Levels 1–6 may be used, as well as any other type of wellbore junction.

Thus, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A method of gravel packing a first wellbore communicated with a second wellbore at an intersection between the first and second wellbores, the method comprising the steps of:

positioning a sand control device in the first wellbore;

placing gravel in an annulus formed between the sand control device and the first wellbore; and flowing a retainer material into the annulus, the retainer material extending from the gravel interiorly through the first wellbore to the intersection and preventing displacement of the gravel in the annulus.

2. The method according to claim 1, wherein the flowing step further comprises the step of permitting the retainer material to set in the annulus, the retainer material when set abutting the gravel and preventing the gravel from displacing in the annulus.

3. The method according to claim 2, wherein in the flowing step, the retainer material is cementitious, so that the retainer material is hardened when set.

4. The method according to claim 2, wherein in the flowing step, the retainer material is gelatinous, so that the retainer material is gelled when set.

5. The method according to claim 1, wherein in the positioning step, the sand control device is connected to a tubular string in the wellbore, and wherein in the flowing step, the retainer material is flowed into the annulus between the tubular string and the wellbore.

6. The method according to claim 1, wherein the flowing step is performed after the placing step.

7. The method according to claim 1, wherein the flowing step is performed in a manner such that the retainer material extends into the second wellbore through the intersection.

8. A method of gravel packing a wellbore, the method comprising the steps of:

positioning a sand control device in the wellbore; placing gravel in an annulus formed between the sand control device and the wellbore; and flowing a retainer material into the annulus, the retainer material preventing displacement of the gravel in the annulus, wherein in the positioning step, the sand control device is connected to a tubular string in the wellbore, wherein in the flowing step, the retainer material is flowed into the annulus between the tubular string and the wellbore, and wherein the flowing step further comprises flowing the retainer material into the annulus via at least one ported collar interconnected in the tubular string.

* * * * *